US010414539B2

(12) United States Patent
Dorminey et al.

(10) Patent No.: US 10,414,539 B2
(45) Date of Patent: Sep. 17, 2019

(54) REINFORCED CONTAINER

(71) Applicant: Georgia-Pacific Corrugated LLC, Atlanta, GA (US)

(72) Inventors: Bryan Keith Dorminey, Lawrenceville, GA (US); James Brian Patterson, Waxahachie, TX (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 0 days.

(21) Appl. No.: 16/004,654

(22) Filed: Jun. 11, 2018

(65) Prior Publication Data

US 2018/0354677 A1 Dec. 13, 2018

Related U.S. Application Data

(60) Provisional application No. 62/518,057, filed on Jun. 12, 2017.

(51) Int. Cl.
*B65D 5/44* (2006.01)
*B65D 5/00* (2006.01)
(Continued)

(52) U.S. Cl.
CPC ..... *B65D 5/443* (2013.01); *B65D 5/003* (2013.01); *B65D 5/0015* (2013.01); *B65D 5/10* (2013.01);
(Continued)

(58) Field of Classification Search
CPC ..... B65D 5/443; B65D 5/0015; B65D 5/003; B65D 5/10; B65D 5/4266; B65D 5/001; B31B 50/22; B29C 67/0044
(Continued)

(56) References Cited

U.S. PATENT DOCUMENTS 2,710,134 A 6/1955 Schroeder
3,163,344 A * 12/1964 Tunick ..... B65D 5/4295 206/509
(Continued)

FOREIGN PATENT DOCUMENTS

FR 2196636 A5 3/1974
FR 2240156 A1 3/1975
WO 2014110070 A1 7/2014

OTHER PUBLICATIONS

International Search Report and Written Opinion mailed in international application No. PCT/US2011/050347 dated Mar. 19, 2012.
(Continued)

*Primary Examiner* — Christopher R Demeree

(57) ABSTRACT

A reinforced container includes first, second and third panels, the first and second panels having a first fold line therebetween, the first and third panels having a second fold line therebetween, the first and second panels being disposed parallel to the z-axis, the third panel being disposed orthogonal to the z-axis, and the first fold line defining a first corner oriented parallel to the z-axis. A strength enhancing feature is disposed at the top of the first corner with a continuous planar edge orthogonal to the z-axis. The third panel defines a top surface of the container, the planar edge of the strength enhancing feature being disposed substantially parallel with at least a portion of the top surface, and the top surface has a corner portion disposed relative to the planar edge at a distance no greater than one half thickness of the third panel above the planar edge.

20 Claims, 5 Drawing Sheets

(51) Int. Cl.

| | |
|---|---|
| ***B65D 5/10*** | (2006.01) |
| ***B65D 5/42*** | (2006.01) |
| *B31B 120/70* | (2017.01) |
| *B31B 100/00* | (2017.01) |
| *B31B 50/26* | (2017.01) |
| *B31B 120/00* | (2017.01) |

(52) U.S. Cl.
CPC ..... *B65D 5/4266* (2013.01); *B31B 50/26* (2017.08); *B31B 2100/00* (2017.08); *B31B 2120/502* (2017.08); *B31B 2120/70* (2017.08)

(58) Field of Classification Search
USPC .... 229/100, 915, 918, 920, 198.2, 164, 179; 206/521, 585
See application file for complete search history.

(56) References Cited

U.S. PATENT DOCUMENTS

| | | | | | |
|---|---|---|---|---|---|
| 3,520,468 | A | * | 7/1970 | Wiemann | B65D 5/001 206/508 |
| 3,532,263 | A | * | 10/1970 | Ross | B65D 5/10 206/521 |
| 3,973,723 | A | | 8/1976 | Owens | |
| 4,082,215 | A | | 4/1978 | Eichenauer | |
| 4,245,773 | A | | 1/1981 | Stollberg | |
| 5,039,005 | A | | 8/1991 | Flaming | |
| 5,115,965 | A | * | 5/1992 | Girona Alepuz | B65D 5/001 206/315.9 |
| 5,392,985 | A | | 2/1995 | Smith et al. | |
| 5,458,283 | A | | 10/1995 | Southwell et al. | |
| 6,092,716 | A | * | 7/2000 | Smith | B65D 5/16 229/117 |
| 7,635,080 | B2 | | 12/2009 | Conway | |
| 8,851,362 | B2 | | 10/2014 | Aksan et al. | |
| 9,527,622 | B2 | | 12/2016 | Carman | |
| 9,815,585 | B2 | | 11/2017 | Gasior et al. | |
| 2009/0098991 | A1 | | 4/2009 | Graham | |
| 2012/0055922 | A1 | | 3/2012 | Aksan et al. | |
| 2013/0126594 | A1 | | 5/2013 | Gasior | |
| 2014/0042216 | A1 | | 2/2014 | Cameron | |
| 2016/0068298 | A1 | | 3/2016 | Westney et al. | |

OTHER PUBLICATIONS

International Search Report and Written Opinion mailed in international application No. PCT/US2014/010587 dated May 14, 2014.
Extended European Search Report dated Jun. 11, 2015 in European patent application No. 11822726.3.
Extended European Search Report dated Mar. 29, 2018 for Application No. 17159609.1.
PCT International Search Report and Written Opinion mailed in international application No. PCT/US18/36818 dated Aug. 8, 2018.
PCT International Search Report and Written Opinion for PCT/US2018/054540 dated Dec. 14, 2018.

* cited by examiner

REINFORCED CONTAINER

CROSS REFERENCE TO RELATED APPLICATIONS

This application claims the benefit of U.S. Provisional Application Ser. No. 62/518,057, filed Jun. 12, 2017, which is incorporated herein by reference in its entirety.

BACKGROUND OF THE INVENTION

The subject matter disclosed herein relates to containers, particularly to packing containers, and more particularly to reinforced packing containers suitably configured for stacking and aligning one on top of another.

Packing containers are often formed from a corrugated sheet product material that is cut with a die to form a flat blank, or scored and slotted to form a flat blank. The flat blank is folded into a three-dimensional container that may be secured using an arrangement of flaps, adhesive liquids, staples or adhesive tapes.

In use, packing containers may be subjected to considerable forces during shipping, storage and stacking. While existing packing containers may be suitable for their intended purpose, the art relating to packing containers would be advanced with an increase in the compression strength and rigidity of packing containers, particularly with respect to stacking in combination with aligning, while reducing the amount of materials used to form the packing containers.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment includes a reinforced container, having: a plurality of planar panels integrally arranged with respect to each other and with respect to a set of orthogonal x, y and z axes, the z-axis defining a direction line in which the container is configured to support a stacking load, the plurality of panels being foldable to create the container; the plurality of planar panels comprising a first panel, a second panel, and a third panel, wherein the first panel and the second panel form a contiguity with a first fold line disposed therebetween, wherein the first panel and the third panel form a contiguity with a second fold line disposed therebetween, wherein the first panel and the second panel are each disposed parallel to the z-axis, wherein the third panel is disposed orthogonal to the z-axis, and wherein the first fold line defines a first corner of the container oriented parallel to the z-axis; a first strength enhancing feature disposed at an upper end of the first corner and having a continuous first planar edge orthogonal to the z-axis and having a first portion oriented orthogonal to the first panel and a second portion oriented orthogonal to the second panel; wherein the third panel has an upper outer surface that defines a top surface of the container; wherein the first planar edge of the first strength enhancing feature is disposed substantially parallel with at least a portion of the top surface; and wherein the upper outer surface of the third panel has a corner portion that is disposed relative to the first planar edge at a distance no greater than one half thickness of the third panel above the first planar edge.

An embodiment includes a flat blank having a material composition and a structural configuration sufficient to produce the above noted reinforced container.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying non-limiting drawings in which like elements are numbered alike in the accompanying Figures where:

DETAILED DESCRIPTION OF THE INVENTION

Figure 1:
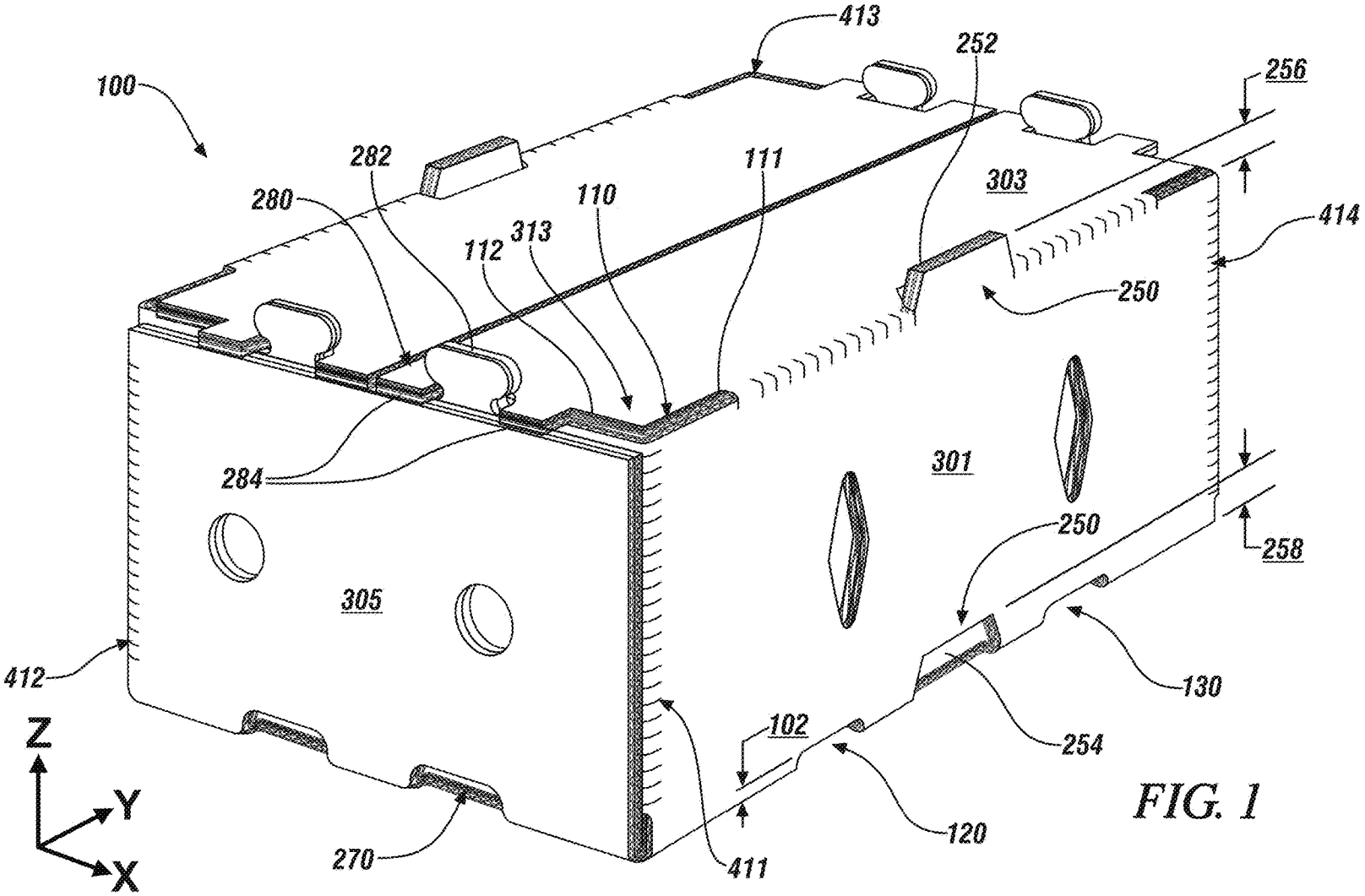
FIG. 1 depicts a rotated isometric view of a reinforced container, in accordance with an embodiment.

A packing container, also referred to as a carton or simply as a container, may be fabricated by, for example, cutting or scoring a sheet product with a die or other type of cutting or scoring tool, such as cutting, scoring and slotting tooling and equipment, to form a flat sheet having various panels, flaps, tabs, recesses and creases. The sheet may be folded and secured using, for example, adhesive liquids, tapes or mechanical means such as staples or straps to form a three-dimensional packing container. Packing containers may be formed from a variety of sheet products. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentangled (sometimes called spunlace), DRC (double re-creped), air laid, spunbond, carded, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Sheet product for packing containers may also include corrugated fiber board, which may be made from a variety of different flute configurations, such as A-flute, B-flute, C-flute, E-flute, F-flute, or micro-flute, for example. In an embodiment, a packing container as disclosed herein may be fabricated from a single piece of corrugated fiber board or corrugated cardboard, from multiple layers of corrugated fiber board or corrugated cardboard that are adhered to each other, or from multiple pieces of corrugated fiber board or corrugated cardboard. The corrugated board material (fiber board or cardboard) may be of single wall, double wall, or triple wall construction, or may have any other wall construction suitable for a purpose disclosed herein.

In use, a packing container may be subjected to various forces during handling, shipping and stacking of the packing container including, for example, compressive forces exerted between the top and bottom panels of the container. It is desirable for a packing container to withstand the various forces to protect objects in the container and to maintain a presentable appearance following shipping. It is also desirable to reduce the amount of materials used to form the packing container while maintaining design specifications for strength and rigidity.

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

An embodiment, as shown and described by the various figures and accompanying text, provides an engineered container having at least one strength enhancing feature, and typically several strength enhancing features, that provides improved compression reinforcement as compared to a similarly configured container absent the same strength enhancing features disclosed herein. While an embodiment described herein depicts a six-sided enclosed container having a top surface (wall), a bottom surface (wall), and four lateral sides (walls), with a plurality of panels having certain structural dimensional relationships relative to each other as an example multi-sided container, it will be appreciated that the disclosed invention is not so limited and may also be applicable to other multi-sided enclosed containers having more than four lateral sides, such as five, six, seven or eight sides, with a plurality of panels having different structural dimensional relationships relative to each other but consistent with an embodiment disclosed herein.

Figure 2:
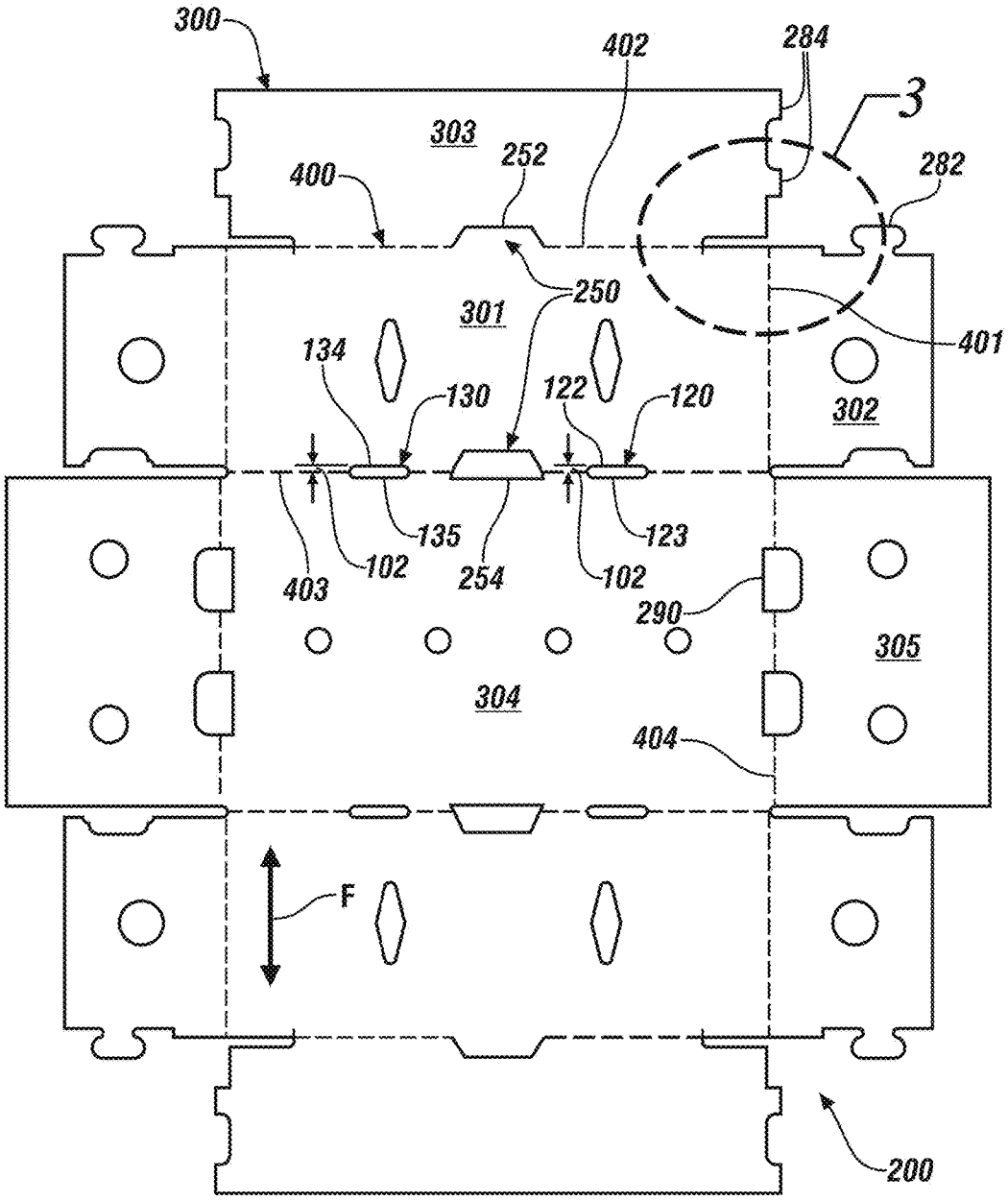
FIG. 2 depicts a flat blank of a plurality of planar panels suitable for making the container of FIG. 1, in accordance with an embodiment.
Figure 3:
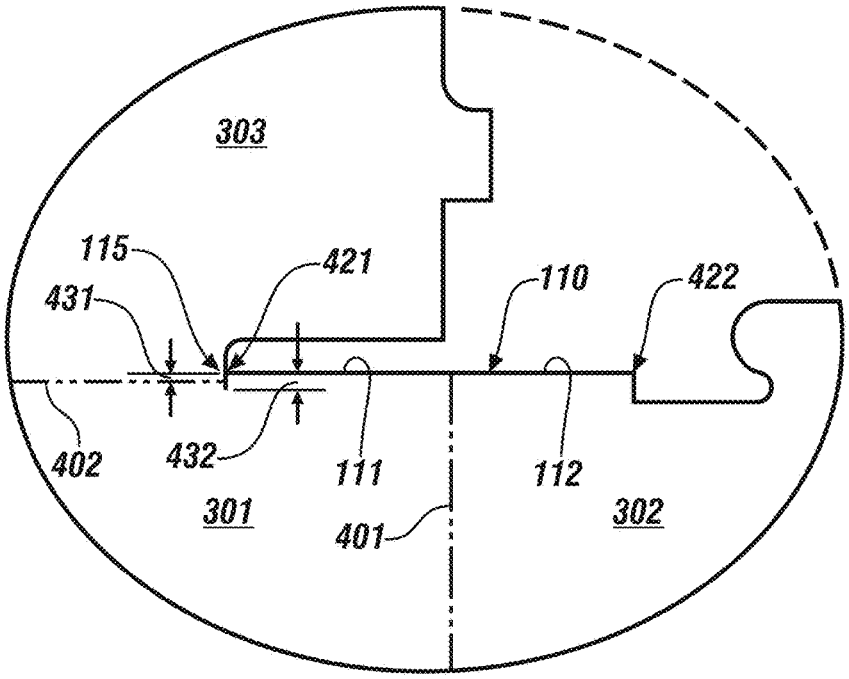
FIG. 3 depicts an enlarged view of Detail-3 of FIG. 2, in accordance with an embodiment.
Figure 4:
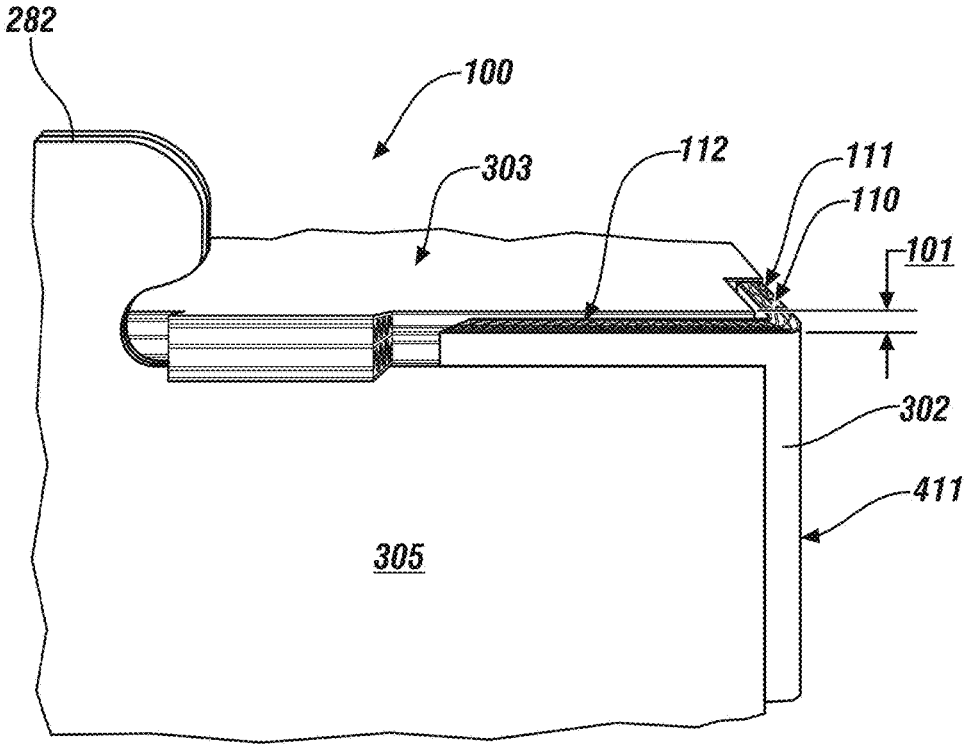
FIG. 4 depicts a partial end view of the container of FIG. 1, in accordance with an embodiment.

FIG. 1 depicts an example embodiment of a container 100, FIG. 2 depicts an example embodiment of a flat blank 200 having a material composition and a structural configuration suitable for forming the container 100, FIG. 3 depicts an enlarged view of Detail-3 of FIG. 2, and FIG. 4 depicts an enlarged view of an end region proximate a first corner (discussed below) of the container 100 of FIG. 1. Reference is now made to FIGS. 1, 2, 3 and 4 in combination.

An embodiment of the container 100 includes a plurality of planar panels 300 that are integrally arranged with respect to each other and with respect to a set of orthogonal x, y and z axes, where the z-axis defines a direction line in which the container 100 is configured to support a stacking load. The plurality of panels 300 are foldable via a plurality of fold lines 400 (depicted as dashed lines in FIG. 2) to create the three dimensional container 100. In general and unless otherwise specified, dashed lines in FIG. 2 depict fold lines, which may or may not be scored or perforated, and solid lines in FIG. 2 depict cut lines, which may be die cut or otherwise through cut. In an embodiment, the plurality of planar panels 300 are fabricated from a single piece of corrugated fiber material (single-wall or multi-wall) having a defined caliper thickness and with the corrugations, or flutes, oriented parallel to the "F" direction line (see FIG. 2), which is parallel to the z-axis for at least some of the plurality of panels 300 of the folded container 100 (as can be seen with reference to at least FIGS. 1 and 2 for example).

The plurality of planar panels 300 include a first panel 301, a second panel 302 (hidden from view in FIG. 1 and best seen in FIG. 2), and a third panel 303. The first panel 301 and the second panel 302 form a contiguity with a first fold line 401 disposed therebetween, and the first panel 301 and the third panel 303 form a contiguity with a second fold line 402 disposed therebetween. The first panel 301 and the second panel 302 are each disposed parallel to the z-axis, and the third panel 303 is disposed orthogonal to the z-axis (best seen with reference to FIG. 1). The first fold line 401 defines a first corner 411 of the container 100 oriented parallel to the z-axis.

A first strength enhancing feature (SEF1) 110 is disposed at an upper end (relative to the z-axis) of the first corner 411 and has a continuous first planar edge orthogonal to the z-axis having a first portion 111 oriented orthogonal to the first panel 301 and a second portion 112 oriented orthogonal to the second panel 302. In view of the flutes of the corrugated fiber board of the container 100 being oriented parallel to the "F" direction line (see FIG. 2), and the planar edge of the SEF1 110 being formed via a through-cut process, it will be appreciated that the SEF1 110 is formed having exposed flute ends on the through-cut edge at the upper end of the first corner 411.

With reference now particularly to FIGS. 1 and 4, the third panel 303 has an upper outer surface that defines at least a portion of a top surface (also herein referred to by reference numeral 303) of the container 100, and the first planar edge 111, 112 (separately herein referred to as the first portion 111 and the second portion 112) of the SEF1 110 is disposed substantially parallel with at least a portion of the top surface 303, which can be seen in FIG. 4, where the design details in combination with fabrication tolerances and manufacturing processes relating to the flat blank 200 and the container 100 (with an optional locking feature discussed further below) may result in the upper outer surface of the third panel 303 being slightly angled or slightly elevated relative to the first planar edge 111, 112 resulting in a height/distance 101 that the upper outer surface of the third panel 303 may sit above the first planar edge, particularly the second portion 112, of the SEF1 110 when the plurality of planar panels 300 are folded to form the container 100. As used herein, the term "substantially parallel" means parallel with variations permitted to accommodate for design details, fabrication tolerances and manufacturing processes associated with making the finished folded container 100.

In view of the foregoing and with reference now to FIG. 5 in combination with FIGS. 1-4, it will be appreciated that the structural relationship between the SEF1 110 and the top surface 303 may be described as follows. In an embodiment, the upper outer surface of the third panel 303 has at least a portion of a corner portion surface 313 that is disposed at substantially the same height as the first planar edge 111, 112 (relative to the bottom surface of the container) or at a height/distance no greater than a defined distance above the first planar edge 111, 112, and a cut edge 314 of the corner portion surface 313 of the third panel 303 is disposed inboard of inner surfaces of the first panel 301 and the second panel 302. In an embodiment, the corner portion surface 313 of the outer surface of the third panel 303 is disposed relative to the first planar edge 111, 112 at a height/distance 101 (best seen with reference to FIG. 4) that is no greater than one half thickness of the third panel 303 above the first planar edge 111, 112. By structuring the first planar edge 111, 112 of the SEF1 110 relative to the top surface 303 of the container 100 as disclosed herein (i.e., substantially parallel), it has been found that improved load distribution to the SEF1 110 is achieved when two or more of the containers 100 are stacked one on top of the other, resulting in improved stacking compression strength.

Reference is now made particularly to FIG. 3. In an embodiment, the first planar edge 111, 112 is formed by a first cut line (solid line associated with SEF1 110 and also herein referred to by reference numeral 110) that extends across the first fold line 401 from a first point 421 on the first panel 301 to a second point 422 on the second panel 302, and the first planar edge 111, 112 is disposed parallel to and at a defined first distance 431 greater than zero above (relative to the z-direction) the second fold line 402. In an embodiment, the third panel 303 is at least partially defined by a second cut line 115 that is perpendicular to the first cut line 110 and extends across the second fold line 402 from the third panel 303 to the first panel 301 through the first point 421 of the first cut line 110 to terminate at a defined second distance 432 greater than zero below the first cut line 110 on the first panel 301. In an embodiment, the defined first distance 431 is at a distance of equal to or less than one half thickness of the first panel 301, and alternatively equal to or less than one quarter thickness of the first panel 301. In an embodiment, the defined second distance 432 is at a distance of equal to or greater than one quarter thickness of the first panel 301, and alternatively equal to or greater than one half thickness of the first panel 301. In an embodiment, the defined second distance 432 is at a distance of equal to or less than a thickness of the first panel 301. In general and consistent with an embodiment disclosed herein, the first and second cut lines 110, 115 are arranged relative to each other and relative to the second fold line 402 so as to purposefully produce the SEF1 110 with the first planar edge 111, 112 having undeformed exposed flutes when the plurality of planar panels 300 are folded to form the container 100.

Figure 5:
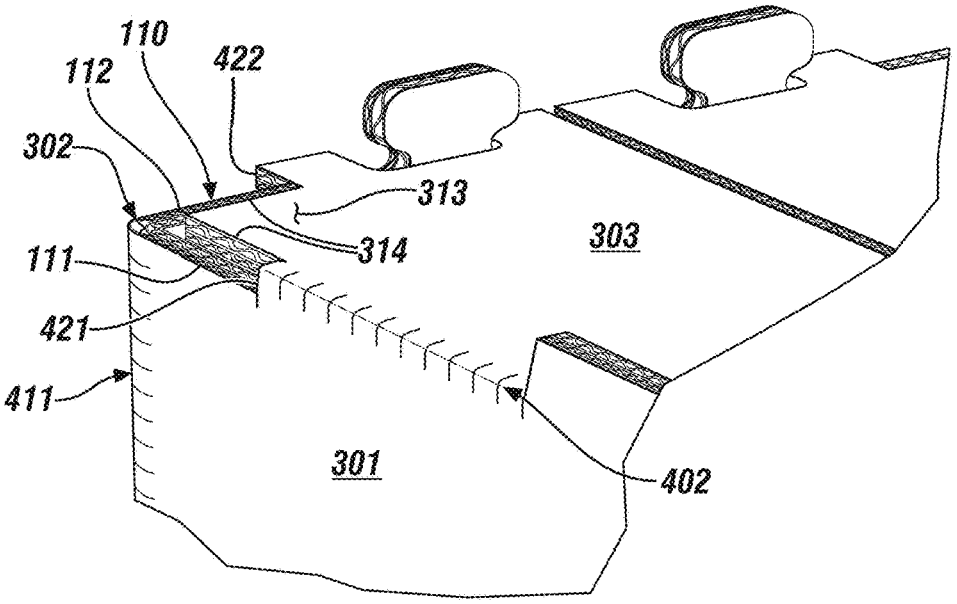
FIG. 5 depicts a rotated isometric view of the partial end view of FIG. 4, in accordance with an embodiment.

With reference briefly to FIGS. 3 and 5, it can be seen that the corner portion surface 313 of the upper outer surface of the third panel 303 is disposed between the first point 421 and the second point 422 of the first planar edge 111, 112.

Further to the foregoing, the plurality of planar panels 300 further include a fourth panel 304 that forms a contiguity with the first panel 301 with a third fold line 403 disposed therebetween, where the fourth panel 304 is disposed parallel to the third panel 303 and has a lower outer surface that defines a bottom surface (also herein referred to by reference numeral 304) of the container 100. In an embodiment, a second strength enhancing feature (SEF2) 120 is disposed along the third fold line 403 having a first slot (also herein referred to by reference numeral 120) having a second planar edge 122 oriented orthogonal to the first panel 301 and orthogonal to the z-axis, and a third planar edge 123 oriented orthogonal to the fourth panel 304 and parallel to the z-axis. The second planar edge 122 is disposed parallel to and a distance 102 away from the third fold line 403 at a distance no greater than a thickness of the first panel 301, and alternatively is disposed a distance away from the third fold line 403 at a distance no greater than a half thickness of the first panel 301. In an embodiment, the plurality of planar panels 300 include a third strength enhancing feature 130 that is a replica of the second strength enhancing feature, SEF2, disposed along the third fold line 403 having a second slot (also herein referred to by reference numeral 130) having a fourth planar edge 134 oriented orthogonal to the first panel 301 and orthogonal to the z-axis, and a fifth planar edge 135 oriented orthogonal to the fourth panel 304 and parallel to the z-axis. Similar to the second planar edge 122, the fourth planar edge 134 is disposed parallel to and a distance 102 away from the third fold line 403 at a distance no greater than a thickness of the first panel 301, and alternatively is disposed a distance away from the third fold line 403 at a distance no greater than a half thickness of the first panel 301. As depicted in FIG. 1, the second strength enhancing feature 120 and the third strength enhancing feature 130 are spaced apart from each other, and in an embodiment are symmetrically spaced apart relative to a vertical line at the center of the first panel 301 of the container 100.

Figure 6:
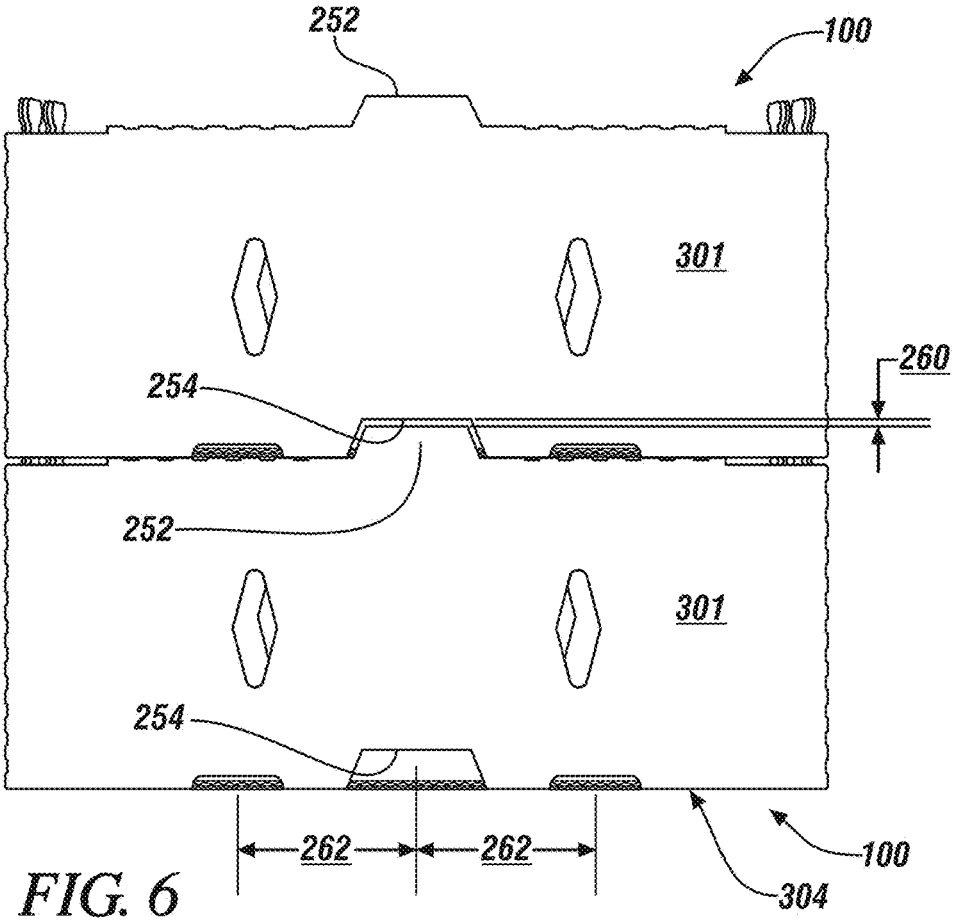
FIG. 6 depicts a side view of two containers of FIG. 1 stacked one on top of the other, in accordance with an embodiment.

With reference now made back to FIGS. 1 and 2, in combination with FIG. 6, an embodiment of the container 100 includes an alignment feature (AF) 250 comprising a top tab 252 disposed along the second fold line 402, and a bottom slot 254 disposed along the third fold line 403, where the top tab 252 is an undeformed contiguous planar extension of the first panel 301, and the bottom slot 254 is formed at least partially by a cutout (also herein referred to by reference numeral 254) in the first panel 301 and the fourth panel 304 (best seen in FIG. 2). As depicted in FIGS. 1 and 2, the top tab 252 and the bottom slot 254 are in vertical alignment with each other relative to the z-axis, and the top tab 252 and the bottom slot 254 have complementary shapes with respect to each other, such as but not limited to trapezoidal shapes for example. The top tab extends a defined height 256 in the z-direction above the top surface 303, and the cutout 254 of the bottom slot extends into the first panel 301 a defined height 258 in the z-direction above the outer bottom surface of the fourth panel 304.

In an embodiment, the defined height 256 of the top tab 252 is less than the defined height 258 of the bottom slot 254 by a defined amount to provide a defined compression relief gap 260 in an unloaded stacked arrangement of two or more reinforced containers 100, 100. In an embodiment, the compression relief gap 260 is a defined amount that is designed to not only enable the engagement of a lower tab 252 with an upper slot 254 to provide sideways alignment of the stacked containers 100, 100, but also to contribute to a synergistic effect of improved stacking compression strength, which will be discussed further below. Without being held to any particular theory, it is contemplated that by having a compression relief gap 260 that avoids an initial interference of the tab-to-slot when the bottom surface 304 of the top container 100 first engages the top surface 303 of the bottom container 100 during stacking, the load distribution to the SEF1s 110 is enhanced by avoiding premature engagement of the tab-to-slot as the upper container 100 compresses under load on the lower container 100. As such, the AF 250 has also been found to function as a compression strength enhancing feature, when applied as described herein. In an embodiment, the defined amount of the compression relief gap 260 is greater than zero and equal to or less than a thickness of the first panel 301. In another embodiment, the defined amount of the compression relief gap 260 is greater than zero and equal to or less than a half thickness of the first panel 301. In an embodiment and as depicted in FIG. 6, the second strength enhancing feature (SEF2) 120 and the third strength enhancing feature (SEF2) 130 are disposed equidistant 262 from and on opposing sides of the bottom slot 254 of the AF 250.

Figure 7:
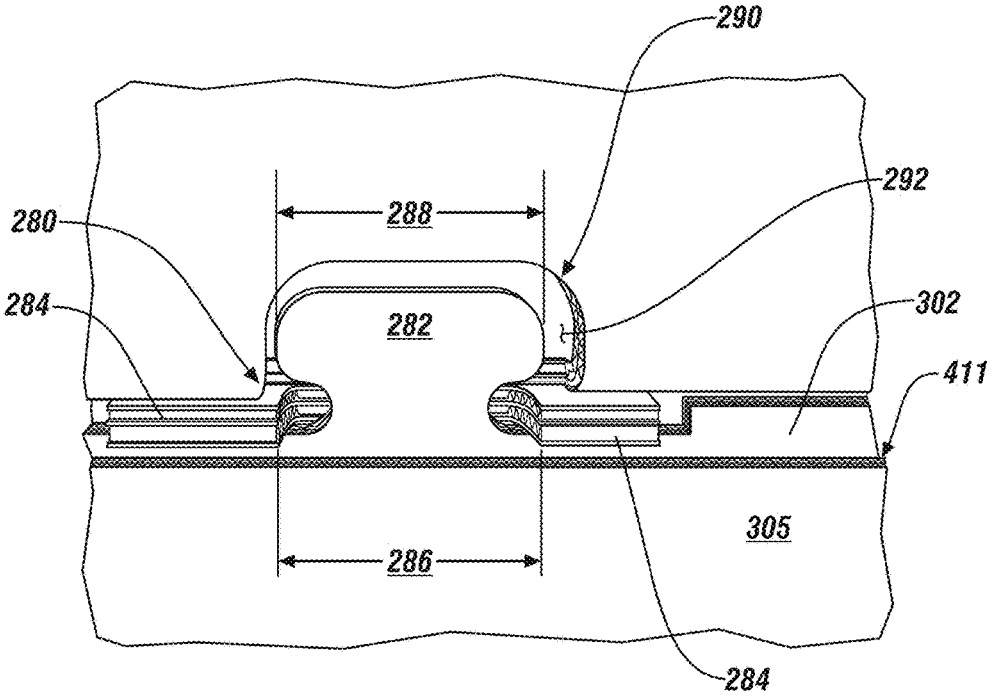
FIG. 7 depicts a partial end view of two containers of FIG. 1 stacked one on top of the other, in accordance with an embodiment.

Reference is now made to FIGS. 1, 2 and 7, where the plurality of planar panels 300 further includes a fifth panel 305 that forms a contiguity with the fourth panel 304 with a fourth fold line 404 disposed therebetween, and where the fifth panel 305 is disposed parallel to and in direct contact with the second panel 302 (also seen in FIG. 4). In an embodiment, an optional locking feature 280 includes a T-shaped tab 282 disposed at an upper end of the second panel 302 and sideways displaced from the first corner 411, and two engagement tabs 284 disposed on the third panel 303 that are removably and interferingly engageable with the T-shaped tab 282. In an embodiment, the T-shaped tab 282 is an undeformed contiguous planar extension of the second panel 302 that extends above the top surface 303 of the container 100, and the two engagement tabs 284 are each an undeformed contiguous planar extension of the third panel 303 that extend sideways outward of the second panel 302. As depicted in FIG. 7, the two engagement tabs 284 have an inside opening 286, and the T-shaped tab 282 has an outer dimension 288 that is greater than the inside opening 286, so that the T-shaped tab 282 interferingly engages with the two engagement tabs 284 when the top cover, panel 303 for example, of the container 100 is closed. To enable stacking of two or more containers 100, a bottom opening 290 is disposed along the fourth fold line 404 that extends into the fourth panel 304 and into the fifth panel 305, where the T-shaped tab 282 and the bottom opening 290 are in vertical alignment with each other relative to the z-axis, and where the bottom opening 290 is configured to be larger than the T-shaped tab 282 to provide a defined engagement relief gap 292 in a stacked arrangement of two or more of the containers 100 (best seen with reference to FIG. 7).

From all of the foregoing, it will be appreciated that an embodiment of the container 100 described and illustrated herein is not limited to only one SEF1 110, or only one SEF2 120, or only one AF 250, for providing improved compression strength, but may encompass any suitable number of SEF1s 110, SEF2s 120, and AFs 250, which can be clearly seen with reference to the several figures provided herewith. As such, it will be appreciated that an embodiment of the container 100 includes an arrangement where the plurality of planar panels 300 define a plurality of corners that includes the first corner 411, and further includes at least a second corner 412, a third corner 413, and a fourth corner 414, where each of the second corner 412, the third corner 413, and the fourth corner 414 is oriented parallel to the z-axis, and where each of the second corner 412, the third corner 413, and the fourth corner 414 includes structure substantially similar to that of the SEF1 110 disposed at an upper end of the respective corner. Furthermore, it will be appreciated that an embodiment of the container 100 described and illustrated herein further includes any suitable number of compression strength enhancing features substantially, similar to that of the SEF2 120, 130, disposed along a respective bottom edge on the side of the container 100 hidden from view in FIG. 1, and further includes any suitable number of alignment features, and herein found to be synergistic compression strength enhancing features, substantially similar to that of the AF 250 disposed along a respective top edge of the container 100 (visible in FIG. 1). All such combinations of SEF1s, SEF2s and AFs, as disclosed herein, are contemplated and considered to be within the scope of the invention disclosed herein.

It has been found through empirical compression testing that a multi-sided container 100 having a combination of compression strength enhancing features, SEF1s and SEF2s, and alignment features AFs, as disclosed herein, provides a container having improved stacking compression strength as compared to a similarly shaped and sized control sample container having SEF1s alone, SEF2s alone, AFs alone, a combination of SEF1s and SEF2s, a combination of SEF1s and AFs, or a combination of SEF2s and AFs. More particularly, empirical compression testing uncovered an unexpected advantage relating to the use of the AFs. It was found that the use of AFs alone, or in combination with either SEF1s or SEF2s, provided little or no improvement, or in some cases decreased improvement, in the compression strength of the container 100, but when the AFs were employed in combination with SEF1s and SEF2s a synergistic effect of all three features resulted in an unexpected overall improvement in compression stacking strength. Stated alternatively, it was found that the synergistic effect of all three features, SEF1s, SEF2s and AFs, as herein disclosed provides a not insubstantial improvement in the stacking compression strength of the multi-sided container 100 equipped with such combination of features. That said, empirical testing did show that the SEF1s alone, or the SEF2s alone, or the combination of the SEF1s and the SEF2s, did result in an improvement in compression stacking strength, but as discussed herein, the combination of all three features, SEF1s, SEF2s and AFs, provided an even greater synergistic improvement in compression stacking strength.

As used herein, the terms orthogonal (perpendicular) and parallel should be interpreted as being substantially orthogonal (perpendicular) and substantially parallel, respectively. For example, the term orthogonal in relation to planar surfaces should be interpreted to include two planar surfaces having an angle therebetween from 85-degrees to 95-degrees, or more typically from 88-degrees to 92-degrees, depending on whether the measurement is taken when the container is in a non-compressed state or a partially compressed state. And the term parallel in relation to planar surfaces should be interpreted to include two planar surfaces having an angle therebetween from +5 degrees to −5 degrees, or more typically from +2 degrees to −2 degrees, depending on whether the measurement is taken when the container is in a non-compressed state or a partially compressed state.

As used herein, any reference to a dimension or a percentage value should not be construed to be the exact dimension or percentage value stated, but instead should be understood to mean a dimension or percentage value that is "about" the stated dimension or percentage value so to accommodate dimensional tolerances, except where it is clear from the description and usage as presented herein.

As used herein, any reference to structural features that are "substantially planar", "substantially flush", or "substantially similar", should not be construed to be unbounded in their respective structure, but instead should be understood to mean an arrangement of structural features that are planar, flush, or similar, within an acceptable manufacturing tolerance window that accommodates acceptable dimensional tolerances and manufacturing processes, except where it is clear from the description and usage as presented herein.

While the invention has been described with reference to example embodiments, it will be understood by those skilled in the art that various changes may be made and equivalents may be substituted for elements thereof without departing from the scope of the claims. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed example embodiments and, although specific terms and/or dimensions may have been employed, they are unless otherwise stated used in a generic, example and/or descriptive sense only and not for purposes of limitation, the scope of the claims therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Additionally, the term "comprising" as used herein does not exclude the possible inclusion of one or more additional features.

What is claimed is:

1. A reinforced container, comprising:

a plurality of planar panels integrally arranged with respect to each other and with respect to a set of orthogonal x, y and z axes, the z-axis defining a direction line in which the container is configured to support a stacking load, the plurality of panels being foldable to create the container;

the plurality of planar panels comprising a first panel, a second panel, and a third panel, wherein the first panel and the second panel form a contiguity with a first fold line disposed therebetween, wherein the first panel and the third panel form a contiguity with a second fold line disposed therebetween, wherein the first panel and the second panel are each disposed parallel to the z-axis, wherein the third panel is disposed orthogonal to the z-axis, and wherein the first fold line defines a first corner of the container oriented parallel to the z-axis;

a first strength enhancing feature disposed at an upper end of the first corner and comprising a continuous first planar edge orthogonal to the z-axis and having a first portion oriented orthogonal to the first panel and a second portion oriented orthogonal to the second panel;

wherein the third panel has an upper outer surface that defines a top surface of the container;

wherein the first planar edge of the first strength enhancing feature is disposed substantially parallel with at least a portion of the top surface; and wherein the upper outer surface of the third panel has a corner portion surface that is disposed relative to the first planar edge at a distance no greater than one half thickness of the third panel above the first planar edge.

2. The reinforced container of claim 1, wherein:

at least a portion of the upper outer surface of the third panel is disposed at substantially the same height as the first planar edge; and a cut edge of the corner portion of the third panel is disposed inboard of inner surfaces of the first panel and the second panel.

3. The reinforced container of claim 1, wherein:

the first planar edge is formed by a first cut line that extends across the first fold line from a first point on the first panel to a second point on the second panel; and the first planar edge is disposed parallel to and at a defined first distance greater than zero above the second fold line.

4. The reinforced container of claim 3, wherein:

the third panel is at least partially defined by a second cut line that is perpendicular to the first cut line and extends across the second fold line from the third panel to the first panel through the first point of the first cut line to terminate at a defined second distance greater than zero below the first cut line on the first panel.

5. The reinforced container of claim 3, wherein:

the defined first distance is at a distance of equal to or less than one half thickness of the first panel.

6. The reinforced container of claim 4, wherein:

the defined second distance is at a distance of equal to or greater than one quarter thickness of the first panel.

7. The reinforced container of claim 6, wherein:

the defined second distance is at a distance of equal to or less than a thickness of the first panel.

8. The reinforced container of claim 1, wherein the plurality of planar panels further comprises a fourth panel that forms a contiguity with the first panel with a third fold line disposed therebetween, the fourth panel disposed substantially parallel to the third panel, and further comprising:

a second strength enhancing feature disposed along the third fold line comprising a first slot having a second planar edge oriented orthogonal to the first panel and orthogonal to the z-axis, and a third planar edge oriented orthogonal to the fourth panel and parallel to the z-axis, the second planar edge being disposed parallel to and a distance away from the third fold line at a distance no greater than a thickness of the first panel.

9. The reinforced container of claim 8, further comprising:

a third strength enhancing feature disposed along the third fold line comprising a second slot having a fourth planar edge oriented orthogonal to the first panel and orthogonal to the z-axis, and a fifth planar edge oriented orthogonal to the fourth panel and parallel to the z-axis, the fourth planar edge being disposed substantially parallel to and a distance away from the third fold line at a distance no greater than a thickness of the first panel;

wherein the second strength enhancing feature and the third strength enhancing feature are spaced apart from each other.

10. The reinforced container of claim 9, further comprising:

an alignment feature comprising a top tab disposed along the second fold line, and a bottom slot disposed along the third fold line, the top tab being an undeformed contiguous extension of the first panel, the bottom slot formed at least partially by a cutout in the first panel;

wherein the top tab and the bottom slot are in vertical alignment with each other;

wherein the fourth panel has an outer surface that defines a bottom surface of the container;

wherein the top tab extends a defined height in the z-direction above the top surface, and the cutout of the bottom slot extends in the first panel a defined height in the z-direction above the bottom surface; and wherein the defined height of the top tab is less than the defined height of the bottom slot by a defined amount to provide a defined compression relief gap in a stacked arrangement of two or more of the reinforced container.

11. The reinforced container of claim 10, wherein the top tab and the bottom slot have complementary shapes with respect to each other.

12. The reinforced container of claim 10, wherein the defined amount of the compression relief gap is greater than zero and equal to or less than a thickness of the first panel.

13. The reinforced container of claim 10, wherein the defined amount of the compression relief gap is greater than zero and equal to or less than a half thickness of the first panel.

14. The reinforced container of claim 10, wherein the second strength enhancing feature and the third strength enhancing feature are disposed equidistant from and on opposing sides of the bottom slot of the alignment feature.

15. The reinforced container of claim 9, wherein:

the second planar edge of the second strength enhancing feature is disposed a distance away from the third fold line at a distance no greater than a half thickness of the first panel; and the fourth planar edge of the third strength enhancing feature is disposed a distance away from the third fold line at a distance no greater than a half thickness of the first panel.

16. The reinforced container of claim 10, wherein the plurality of planar panels further comprises a fifth panel that forms a contiguity with the fourth panel with a fourth fold line disposed therebetween, the fifth panel disposed parallel to and in direct contact with the second panel, and further comprising:

a locking feature comprising a T-shaped tab disposed at an upper end of the second panel and sideways displaced from the first corner, and two engagement tabs disposed on the third panel that are removably and interferingly engageable with the T-shaped tab, the T-shaped tab being an undeformed contiguous extension of the second panel that extends above the top surface, the two engagement tabs each being an undeformed contiguous extension of the third panel; and a bottom opening disposed along the fourth fold line that extends into the fourth panel and into the fifth panel;

wherein the T-shaped tab and the bottom opening are in vertical alignment with each other; and wherein the bottom opening is configured to be larger than the T-shaped tab to provide a defined engagement relief gap in a stacked arrangement of two or more of the reinforced container.

17. The reinforced container of claim 1, wherein the plurality of planar panels are fabricated from a single piece of corrugated fiber material with the corrugations oriented parallel to the z-axis.

18. The reinforced container of claim 4, wherein the plurality of planar panels define a plurality of corners that comprises the first corner, and further comprises at least a second corner, a third corner, and a fourth corner;

wherein each of the second corner, the third corner, and the fourth corner is oriented parallel to the z-axis; and wherein each of the second, the third corner, and the fourth corner comprises structure substantially similar to that of the first strength enhancing feature and disposed at an upper end of the respective corner.

19. A flat blank having a material composition and a structural configuration sufficient to produce the reinforced container according to claim 15.

20. A flat blank having a material composition and a structural configuration sufficient to produce the reinforced container according to claim 16.

* * * * *